United States Patent [19]

Tanaka et al.

[11] 4,419,391

[45] Dec. 6, 1983

[54] METHOD OF IMPARTING IMPROVED TOUCH TO A FABRIC

[75] Inventors: Masaki Tanaka, Annaka; Koichi Yamaguchi, Takasaki, both of Japan

[73] Assignee: Shin-Etsu Chemical Co., Ltd., Tokyo, Japan

[21] Appl. No.: 361,036

[22] Filed: Mar. 23, 1982

[30] Foreign Application Priority Data

Mar. 31, 1981 [JP] Japan ..... 56-47547

[51] Int. Cl.[3] ..... B05D 3/02

[52] U.S. Cl. ..... 427/387; 252/8.8; 427/389.9; 427/392; 427/393.1; 427/393.4; 528/37; 528/38

[58] Field of Search ..... 427/387, 389.9, 392, 427/393.1, 393.4, 393.5, 394; 252/8.8 R; 528/37, 38

[56] References Cited

U.S. PATENT DOCUMENTS

| | | | |
|---|---|---|---|
| 4,070,152 | 1/1978 | Pentz | 427/393.4 |
| 4,247,592 | 1/1981 | Kalinowski | 427/387 |
| 4,311,626 | 1/1982 | Ona et al. | 252/8.8 |

FOREIGN PATENT DOCUMENTS

| | | | |
|---|---|---|---|
| 2420151 | 11/1974 | Fed. Rep. of Germany | 427/387 |
| 50-6819 | 1/1975 | Japan | 427/387 |
| 50-43617 | 12/1975 | Japan | 427/387 |
| 1249118 | 10/1971 | United Kingdom | 427/387 |

*Primary Examiner*—Sadie L. Childs

*Attorney, Agent, or Firm*—Hopgood, Calimafde, Kalil, Blaustein & Judlowe

[57] ABSTRACT

The invention provides a novel method for finishing fabrics of not only synthetic but also natural, e.g. cotton, fibers to be imparted with improved touch of softness, slipperiness and sliminess durable against laundering. The method is characterized by the use of a specific organopolysiloxane as the fabric-finishing agent. The organopolysiloxane is a linear diorganopolysiloxane having at least one amino-substituted hydrocarbon group such as an aminopropyl group as the pendant group and the molecular chain ends of the molecule are terminated with alkoxy groups such as methoxy and ethoxy groups.

4 Claims, No Drawings

METHOD OF IMPARTING IMPROVED TOUCH TO A FABRIC

BACKGROUND OF THE INVENTION

The present invention relates to a method for imparting improved touch or feeling to a fabric and composition comprising an organopolysiloxane used therefor. More particularly, the invention relates to a novel method for imparting excellent touch or feeling of softness, smoothness and sliminess to various kinds of organic fibrous materials or fabrics not only of synthetic fibers but also of natural fibers, e.g. cotton, as well as blended yarn fabrics thereof by use of an organopolysiloxane-containing composition hitherto not used for such a purpose.

As is well known, there are widely used various types of fabric-finishing agents in the art such as waxes, alkylketene dimers and octadecylethylene urea as well as softeners containing a cationic surface active agent with an object to impart improved touch of smoothness or softness to fabric products. The fabric-finishing agents also include several types of compositions comprising an organopolysiloxane as the effective ingredient. Such an organopolysiloxane-containing composition is recommended when improvement is desired in respect of the water-repellency, softness, elasticity and tear strength.

Most of the organopolysiloxane-containing fabric-finishing agents comprise an organopolysiloxane fluid as the base ingredient, a cross-linking agent, a catalyst for accelerating the crosslinking reaction and other optional additives. When the organopolysiloxane-containing composition, prepared by blending together all of the components in advance, is unstable and poorly storable due to the premature gelation or other denaturation, the composition is prepared in two or more separate packages each containing a different component or a different combination of the components from the other and the contents of the packages are blended together directly before use for the treatment of the fabrics, on which crosslinking or curing of the organopolysiloxane is to be effected to exhibit the desired improvement in the fabric properties. Such a two- or multi-package crosslinkable type organopolysiloxane-containing composition is less preferred to the one-package type premixed ones due to the lower working efficiency even by setting aside the problem that the improvement obtained with such a composition is sometimes unsatisfactory in respect of the exquisite slipperiness in the touch of the treated fabrics.

There are also known and used organopolysiloxane compositions of non-crosslinking type for the fabric treatment. The mechanism of the improvement of the fabric properties obtained with such a composition is the decrease in the coefficient of friction between the filaments of the fabric by virtue of the layer of the oily organopolysiloxane adhering to the filament surface whereby to facilitate the relative movement of the filaments resulting, as a consequence, in the improvement of the fabric touch such as the softness. The organopolysiloxanes suitable for the formulation of such an organopolysiloxane composition of the non-crosslinking type are exemplified by dimethylpolysiloxanes, diorganopolysiloxanes modified with long-chain alkyl groups or epoxy groups and diorganopolysiloxanes modified with amino groups as are described in Japanese Patent Publications 48-1480 and 54-43617.

One of the problems in the softening treatment by use of the organopolysiloxane composition of the above described type is that sufficient effect of improvement can hardly be obtained in respect of the smoothness and softness of the treated fabric when the fabric is made of pure cotton although considerably satisfactory results can be obtained in the softening treatment of fabrics of a synthetic fiber, e.g. nylon and polyester, or blended yarn fabrics of cotton and these synthetic fibers. Further problem of the prior art silicone-based softening agent for fabric finishing is the relatively poor durability of the softening effect imparted by the treatment therewith when the treated fabric is laundered.

SUMMARY OF THE INVENTION

It is therefore an object of the present invention to provide a novel method for the softening treatment of not only a fabric of a synthetic fiber and a blended yarn fabric of a synthetic fiber and a natural fiber, e.g. cotton, but also a fabric made of pure cotton, according to which very excellent effect of the treatment is imparted to the treated fabric in respect of the pleasant touch or feeling of sliminess with smoothness and softness and remarkably decreased coefficient of friction in comparison with the effects obtained with conventional fabric-finishing softening agents comprising a dimethylpolysiloxane or a modified organopolysiloxane.

Another object of the invention is to provide a method for the fabric finishing with which a softening effect of very high durability against laundering can be obtained in comparison with the conventional methods.

A further object of the invention is to provide a novel fabric finishing agent comprising an organopolysiloxane suitable for use in practicing the above mentioned fabric treatment as the primary object of the invention.

Thus, the inventive fabric finishing agent comprises, as the effective ingredient thereof, an organopolysiloxane of a substantially linear molecular structure terminated with alkoxy groups at both molecular chain ends and represented by the structural formula

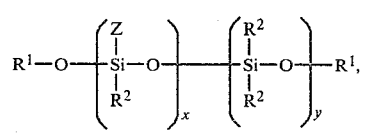

(I)

in which $R^1$ is an alkyl group, $R^2$ is a monovalent hydrocarbon group having from 1 to 20 carbon atoms or a halogen-substituted group thereof, at least 50% by number of the groups denoted by $R^2$ being methyl groups, Z is an amino-substituted monovalent hydrocarbon group represented by the formula $$-R^3-(NH-R^3)_a NH-R^4, \quad \text{(II)}$$

$R^3$ being a divalent hydrocarbon group having from 1 to 5 carbon atoms, $R^4$ being a hydrogen atom, a monovalent hydrocarbon group having from 1 to 20 carbon atoms or a halogen-subtituted group thereof and a being a number of 0, 1, 2 or 3, and x and y are each a positive integer, x+y being sufficiently large to give a viscosity in the range from 50 to 100,000 centistokes at 25° C. to the organopolysiloxane.

The inventive fabric finishing composition is usually prepared by diluting the above defined organopolysiloxane by emulsifying in an aqueous medium or by dissolving in an organic solvent together with other optional additives although undiluted organopolysiloxanes may be used as such when permitted by the method of application.

According to the invention, the above described organopolysiloxane composition is applied to the fabric by soaking, spraying or other suitable coating means followed by drying, preferably, with heating so that an unexpectedly excellent softening effect is obtained with remarkably improved durability of the effect against laundering.

DETAILED DESCRIPTION OF THE PREFERRED EMBODIMENTS

As is understood from the above given description, the most characteristic or effective component in the inventive fabric finishing composition is the organopolysiloxane defined by the general formula (I) which is characterized by the alkoxy groups as the end-blocking groups at both molecular chain terminals and at least one amino-substituted hydrocarbon group Z bonded to the silicon atom.

The alkoxy groups at the molecular chain ends are effective in enhancing the affinity between the organopolysiloxane and the fiber surface resulting in the improved softness and smoothness of the treated fabric. Further, the alkoxy groups are effective for improving the durability of the effect of the treatment against laundering, presumably, due to the increased affinity between the organopolysiloxane and the fiber surface and the entanglement of the fiber molecules and the organopolysiloxane molecules with increased molecular weight as a result of the possible in situ condensation between the terminal alkoxy groups.

The amino-substituted monovalent hydrocarbon group expressed by the symbol Z is introduced to impart smoothness, softness and sliminess to the treated fabric. The organopolysiloxane should have at least one or, preferably, two or more of the groups Z in a molecule although an excessively large number of the groups Z in a molecule is undesirable due to the rather decreased smoothness of the treated fabric. In this respeet, the number of the groups Z in a molecule of the organopolysiloxane is preferably 2 to 20.

The organopolysiloxane of the general formula (I) is a liquid at room temperature having a viscosity in the range from 50 to 100,000 centistokes at 25° C.

The group $R^1$ in the general formula (I) is an alkyl group such as methyl, ethyl, propyl, isopropyl, n-butyl, tert-butyl, octyl and dodecyl groups, among which lower alkyl groups, e.g. methyl and ethyl groups, are preferred.

On the other hand, the group $R^2$ in the general formula (I) may be a monovalent hydrocarbon group having from 1 to 20 carbon atoms including alkyl groups such as those exemplified above for the group $R^1$, cycloalkyl groups such as cyclopentyl and cyclohexyl groups, alkenyl groups such as vinyl and allyl groups, aryl groups such as phenyl, tolyl, xylyl and naphthyl groups and aralkyl groups such as 2-phenylethyl group. The group $R^2$ also may be a halogen-substituted monovalent hydrocarbon group obtained by the partial substitution of halogen atoms such as chlorine and fluorine for the hydrogen atoms in the above named hydrocarbon groups. It is a preferable condition that at least 50% in number of the groups denoted by $R^2$ in the general formula (I) are methyl groups.

The amino-substituted monovalent hydrocarbon group denoted by the symbol Z in the general formula (I) is a group expressed by the general formula (II) above. In this formula, the groups denoted by $R^3$ are each a divalent hydrocarbon group having from 1 to 5 carbon atoms or, in particular, an alkylene group such as methylene, ethylene, propylene and butylene groups. The group $R^4$ is, when it is not a hydrogen atom, a halogen-substituted or unsubstituted monovalent hydrocarbon group having from 1 to 20 carbon atoms exemplified by those similar to the groups given above as the examples of the group $R^2$. Several of the examples of the group Z as expressed by the general formula (II) are: $-(CH_2)_3NH_2$; $-(CH_2)_3NH-CH_2-CH_2-NH_2$; and $-(CH_2)_3NH-CH_2-CH_2)_2NH_2$.

It is noted that the position or positions of the silicon atom or atoms to which one or more of the groups Z are bonded are not particularly limitative in the molecule. In other words, no limitations are given on the order of arrangement of the two types of the siloxane units

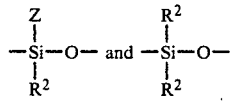

in the molecule of the organopolysiloxane and these siloxane units may be arranged either block-wise or at random.

The organopolysiloxane of the general formula (I) is a diorganopolysiloxane composed of the above named two types of the diorganosiloxane units and has a substantially linear molecular structure although it is optional that the organopolysiloxane is branched by containing a small amount of tri- or tetrafunctional siloxane units together with a corresponding number of monofunctional siloxy units provided that at least two of the chain terminals are blocked with the alkoxy groups.

The method for the preparation of such an organopolysiloxane of the general formula (I) is readily understood by those skilled in the art of silicones by the principle of the alkali-catalyzed siloxane rearrangement reaction of the corresponding siloxane compounds. The siloxane compound for supplying the terminal siloxane units each having an alkoxy group bonded to the silicon atom may be obtained in the form of a disiloxane

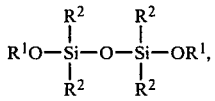

for example, by the partial hydrolysis reaction of a dialkoxy dialkylsilane of the formula $R_2{}^2Si(OR^1)_2$ while the complete hydrolysis of such a silane compound leads to the formation of a polysiloxane compound composed of the difunctional siloxane units $-SiR_2{}^2-O-$ alone, usually, in the form of a cyclic polysiloxane. Similarly, amino-containing siloxane units having or not having an alkoxy group can be obtained from an amino-containing dialkoxysilane of the formula

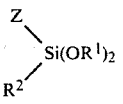

by the partial or complete hydrolysis. These classes of the siloxane compounds are combined together in a suitable proportion to give a desired amount of the amino-substituted groups and a desired viscosity to the product polysiloxane and subjected to the siloxane rearrangement reaction with heating in the presence of an alkali catalyst such as an alkali hydroxide, e.g. sodium and potassium hydroxides, and an alkali siliconate to reach the equilibration.

The above described organopolysiloxane may be used as such for the treatment of fabrics but it is usual that the organopolysiloxane is used in a diluted form in order to improve the workability and to prevent an excessive amount of pick-up of the siloxane on the treated fabric. The dilution of the organopolysiloxane may be performed either by emulsifying the siloxane in an aqueous medium in a finely dispersed liquid droplets or by dissolving the siloxane in an organic solvent. It is also optional that the organopolysiloxane is first diluted with an organic solvent to have a decreased viscosity and the organic solution is then emulsified in an aqueous medium more easily than without the solvent although the use of an organic solvent is generally undesirable in view of the danger of explosion or fire and the problem of pollution of not only the working environment but also the atmospheric air. Therefore it is desirable that the viscosity of the organopolysiloxane per se is relatively low within the range of 50 to 100,000 centistokes at 25° C. so that it can readily be emulsified in an aqueous medium without dilution with an organic solvent.

It is a recommendable way that the aqueous emulsion of the organopolysiloxane is first prepared by the emulsification with a surface active agent to have a content of the siloxane in the range, for example, from 10 to 50% by weight and the treatment of a fabric is performed with an emulsion obtained by further diluting the above high-content master emulsion with a suitable volume of water.

The treatment of a fabric with the inventive organopolysiloxane composition is performed by applying the thus diluted aqueous emulsion to the fabric by the method of dipping, padding, coating, spraying and the like conventional means followed by drying with heating.

It is further optional that the above organopolysiloxane composition contains a crosslinking agent such as an alkoxysilane and methylhydrogenpolysiloxane and a crosslinking catalyst such as the carboxylic acid salt of zinc, tin and the like metal in order to obtain more durable softening effect against laundering with crosslink formation by heating.

The kind of the fibers of which the fabric to be treated according to the invention is, as is mentioned before, not limitative including the synthetic fibers such as polyester fibers, nylon fibers, acrylic fibers, polyethylene fibers and polypropylene fibers and natural fibers such as cotton, flax, wool and the like. The fabric material includes knit, woven and non-woven fabrics and it is of course optional that filaments or yarns are subjected to the treatment according to the invention before being fabricated into fabrics.

In the following, the present invention is described in further detail by way of examples, in which Me and Et denote a methyl group and an ethyl group, respectively, and $Z^1$, $Z^2$ and $Z^3$ each denote an amino-substituted alkyl group of the formula $-(CH_2)_3NH-CH_2-CH_2-NH_2$, $-(CH_2)_3NH_2$ and $-(CH_2)_3(NH-CH_2-CH_2)NH_2$, respectively.

EXAMPLE 1

3-[N-(2-aminoethyl)amino]propyl methyl dimethoxysilane of the formula

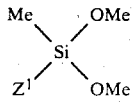

was partially hydrolyzed and condensed to give a disiloxane compound bis-3-[N-2-aminoethyl)amino]-propyl-1,3-dimethyl-1,3-dimethoxy disiloxane of the formula

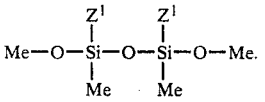

Separately, the same silane compound was fully hydrolyzed with an excessive volume of water to give a cyclic polysiloxane composed of the siloxane unit of

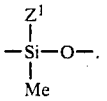

Into a glass flask of 2 liter capacity equipped with a stirrer and a thermometer were introduced 36.6 g of the above prepared disiloxane compound, 32.0 g of the above prepared cyclic siloxane compound, 1480 g of octamethylcyclotetrasiloxane and 0.23 g of potassium hydroxide and the reaction mixture was agitated for 6 hours at 150° C. Thereafter, 3.3 g of epichlorohydrin were added to the mixture followed by agitation for 1 hour at 100° C. to neutralize the alkali catalyst to give a diorganopolysiloxane of the formula

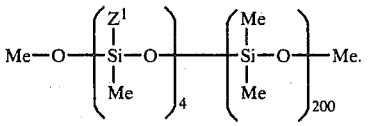

This siloxane product had a viscosity of 750 centistokes at 25° C.

A master emulsion was prepared by vigorously agitating a mixture composed of 150 g of the above obtained organopolysiloxane, 830 g of water and 20 g of a polyoxyethylene alkyl phenyl ether as a nonionic surface active agent by use of a homogenizer and a working emulsion was prepared by diluting 20 g of the above prepared master emulsion with 980 g of water.

The thus obtained working emulsion was used for the treatment of three kinds of fabrics, i.e. a polyester taffeta, 65:35 blended yarn broad cloth of polyester and cotton and cotton broad cloth, by dipping each cloth in the emulsion followed by squeezing in a mangle to give a pick-up amount of the organopolysiloxane of 0.3% and two-step heating for drying first at 100° C. for 2 minutes and then at 150° C. for 2 minutes.

In contrast to the lack of sliminess before treatment, it was noted by an organoleptic test that each of the thus treated fabrics had acquired a sufficient degree of sliminess. The fabrics, both before and after the treatment, were subjected to the measurement of the softness with a feeling tester manufactured by Uenoyama Kiko Co. and the coefficient of static friction with a Heidon type machine. The results are shown in Table 1 below. The value of softness in g is a measure of the resistance of the fabric against folding so that a larger value of softness in g means a larger stiffness of the fabric.

TABLE 1

| | Polyester | | Polyester/cotton (65/35) | | Cotton | |
|---|---|---|---|---|---|---|
| Fabric | Treated | Untreated | Treated | Untreated | Treated | Untreated |
| Softness, g | 30 | 35 | 25 | 32 | 26 | 37 |
| Coefficient of static friction | 0.11 | 0.26 | 0.65 | 0.79 | 0.72 | 0.95 |

EXAMPLE 2

Three amino-containing organopolysiloxanes (a) (b) and (c) as expressed by the structural formulas below and having viscosities of 350, 500 and 430 centistokes, respectively, at 25° C. were prepared in substantially the same manner as in Example 1.

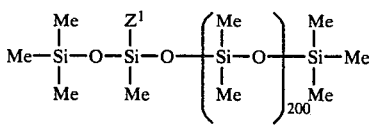

(a)

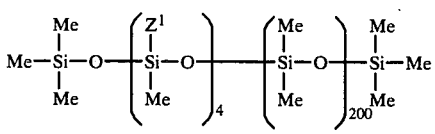

(b)

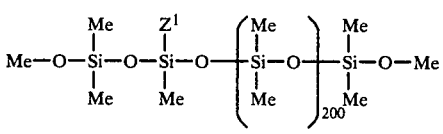

(c)

Each of the above prepared organopolysiloxanes (a), (b) and (c) and the organopolysiloxane prepared in Example 1 (referred to as the organopolysiloxane (d) hereinafter) was dissolved in toluene in a concentration of 1% by weight.

A polyester taffeta cloth was dipped in either one of the above prepared working solutions followed by drying at 120° C. for 2 minutes. The pick-up amount of the organopolysiloxane was 0.5 to 0.6% by weight for each of the solutions.

The thus treated cloths were subjected to the examination of the sliminess, softness and coefficient of static friction in the same manner as in the preceding example either before or after laundering in a household electric washer under standard washing conditions. The results are summarized in Table 2 below together with the results obtained with the same polyester cloth without treatment with the organopolysiloxane solution.

TABLE 2

| Organopolysiloxane | | (a) | (b) | (c) | (d) | None |
|---|---|---|---|---|---|---|
| Before laundering | Slimness | Weak | Good | Good | Very strong | No |
| | Softness, g | 23 | 21 | 25 | 31 | 35 |
| | Coefficient of static friction | 0.14 | 0.12 | 0.12 | 0.11 | 0.26 |
| After laundering | Slimness | Slight | Weak | Good | Strong | — |
| | Softness, g | 30 | 29 | 26 | 30 | — |
| | Coefficient of static friction | 0.23 | 0.18 | 0.14 | 0.12 | — |

As is shown in the table, the comparison between (a) or (b) and (c) or (d) indicates that the treatment with an alkoxyterminated organopolysiloxane is effective in the relatively high value of the softness, relatively unpliable touch, strong sliminess and low coefficient of static friction of the treated test cloths as well as the durability of these properties against laundering.

EXAMPLE 3

A mixture composed of 15.4 g of 1,3-dimethyl-1,3-diethyoxy-1,3-di(3-aminopropyl)disloxane, 11.7 g of 1,3,5,7-tetramethyl-1,3,5,7-tetra(3-aminopropyl)cyclotetrasiloxane, 370.0 g of octamethylcyclotetrasiloxane and 0.6 g of potassium siliconate, of which the content of potassium hydroxide was 10% by weight, was heated for 6 hours at 150° C. with agitation followed by the neutralization of the alkali by the addition of 0.6 g of ethylenechlorohydrin with further agitation for 2 hours at 100° C. to give an organopolysiloxane product expressed by the formula

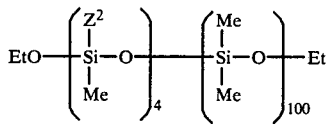

and having a viscosity of 250 centistokes at 25° C.

A master emulsion of the above prepared organopolysiloxane was prepared by emulsifying with vigorous agitation in a homogenizer a mixture composed of 150 g of the above organopolysiloxane, 20 g of a polyoxyethylene alkyl phenyl ether as a nonionic surface active agent and 330 g of water. A working emulsion was prepared by diluting 1 g of this master emulsion with 99 g of water.

A 60/40 blended yarn broad cloth of polyester and cotton was dipped in this working emulsion followed by drying with heating at 150° C. for 3 minutes to give a treated test cloth. This treated test cloth had a very pleasant touch of sliminess and softness in comparison with the same cloth before treatment.

EXAMPLE 4

A working solution was prepared by dissolving 2 g of the organopolysiloxane (d), i.e. the amino-containing organopolysiloxane prepared in Example 1, in 98 g of toluene with admixture of 0.2 g of zinc octoate. A cotton broad cloth was dipped in this working solution and then dried by heating at 150° C. for 3 minutes.

Similarly, the same cotton broad cloth was treated with the same working solution as above excepting the replacement of the organopolysiloxane (d) with the organopolysiloxane (b) prepared in Example 2.

These two test pieces of the treated cotton broad cloths exhibited substantially the same degrees of softness and sliminess, which, however, could be retained in the test cloth treated with the organopolysiloxane (d) even after three times of laundering but hardly retained in the test cloth treated with the organopolysiloxane (b).

EXAMPLE 5

An amino-containing organopolysiloxane expressed by the formula

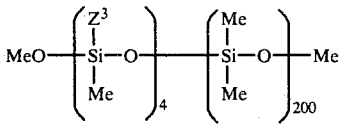

and having a viscosity of 920 centistokes at 25° C. was prepared in a similar manner to the preparation of the organopolysiloxane (d) in Example 1.

A working solution was prepared by dissolving this organopolysiloxane in toluene in a concentration of 1% by weight and a cotton knit cloth was dipped in this solution followed by drying at 120° C. for 3 minutes and then heat treatment at 150° C. for 2 minutes.

The thus treated cloth was found to be imparted with very pleasant touch of softness with sliminess as well as slipperiness in comparison with the same cotton knit cloth before treatment.

What is claimed is:

1. A method for finishing a fabric to impart improved touch thereto which comprises soaking the fabric with a liquid composition containing an amino-containing organopolysiloxane represented by the general formula

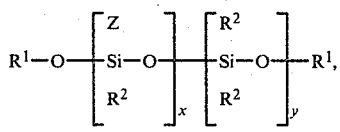

in which $R^1$ is an alkyl group, $R^2$ is a monovalent hydrocarbon group having from 1 to 20 carbon atoms or a halogen-substituted group thereof, at least 50% by number of the groups denoted by $R^2$ being methyl groups, Z is an amino-substituted monovalent hydrocarbon group represented by the formula $$-R^3-(NH-R^3)_aNH-R^4,$$

$R^3$ being a divalent hydrocarbon group having from 1 to 5 carbon atoms, $R^4$ being a hydrogen atom, a monovalent hydrocarbon group having from 1 to 20 carbon atoms or a halogen-substituted group thereof and a being a number of 0, 1, 2 or 3, and x and y are each a positive integer, x+y being sufficiently large to give a viscosity in the range from 50 to 100,000 centistokes at 25° C. to the organopolysiloxane, and then heating the thus soaked fabric.

2. The method as claimed in claim 1 wherein the group denoted by $R^1$ is a methyl or ethyl group.

3. The method as claimed in claim 1 wherein the group denoted by Z is a group selected from the groups expressed by the formulas $$-CH_2)_3NH_2,\ -CH_2)_3NH-CH_2-CH_2-NH_2 \text{ and}$$

$$-CH_2)_3(NH-CH_2-)NH_2.$$

4. The method as claimed in claim 1 wherein the liquid composition containing the amino-containing organopolysiloxane is an aqueous emulsion of the amino-containing organopolysiloxane.

* * * * *